US007001320B1

(12) United States Patent
Focke et al.

(10) Patent No.: US 7,001,320 B1
(45) Date of Patent: Feb. 21, 2006

(54) PROCESS FOR PRODUCING HINGE-LID BOXES

(75) Inventors: Heinz Focke, deceased, late of Verden (DE); by Jurgen Focke, legal representative, Verden (DE); by Doris Focke, legal representative, Verden (DE); Thomas Häfker, Langwedel (DE)

(73) Assignee: Focke & Co., (GmbH & Co), Verden (DE)

( * ) Notice: Subject to any disclaimer, the term of this patent is extended or adjusted under 35 U.S.C. 154(b) by 60 days.

(21) Appl. No.: 10/649,769

(22) Filed: Aug. 28, 2003

(30) Foreign Application Priority Data

Sep. 6, 2002 (DE) ..... 102 41 798

(51) Int. Cl.
*B31B 1/32* (2006.01)

(52) U.S. Cl. ..... 493/165; 493/164; 493/247; 493/397; 493/409; 493/418; 493/424; 493/426

(58) Field of Classification Search ..... 493/164, 493/247, 397, 409, 418, 422, 424, 426, 434–435, 493/445; 53/228, 234
See application file for complete search history.

(56) References Cited

U.S. PATENT DOCUMENTS 3,802,325 A * 4/1974 Bardenhagen et al. ..... 493/17
4,708,704 A * 11/1987 Focke et al. ..... 493/151
5,113,638 A * 5/1992 Focke et al. ..... 53/462
5,261,209 A * 11/1993 Focke et al. ..... 53/410
5,337,622 A * 8/1994 Konzal ..... 74/813 R
5,385,526 A * 1/1995 Sigrist et al. ..... 493/14
5,549,537 A * 8/1996 Focke et al. ..... 493/162
5,674,542 A * 10/1997 Focke et al. ..... 425/297
5,946,890 A * 9/1999 Focke et al. ..... 53/466
5,996,310 A 12/1999 Bailey et al.
6,206,815 B1 * 3/2001 Focke et al. ..... 493/55
6,449,926 B1 * 9/2002 Focke et al. ..... 53/462
6,606,840 B1 * 8/2003 Focke et al. ..... 53/461
6,694,708 B1 * 2/2004 Brizzi et al. ..... 53/462

FOREIGN PATENT DOCUMENTS

| | | |
|---|---|---|
| DE | 35 36 791 A1 | 4/1987 |
| DE | 44 04 278 A1 | 8/1995 |
| EP | 667 230 A1 | 2/1995 |
| EP | 900 646 A1 | 3/1999 |
| EP | 1 145 958 A1 | 10/2001 |

* cited by examiner

*Primary Examiner*—Stephen F. Gerrity
*Assistant Examiner*—Hemant M. Desai
(74) *Attorney, Agent, or Firm*—Sughrue Mion, PLLC

(57) ABSTRACT

In the production of (cigarette) packs of the hinge-lid-box type with round edges, preliminary deformation of blanks (10) is desirable for producing hinge-lid boxes of satisfactory quality. The preliminary deformation of the round edges takes place in the region of a rounding turret (18) during transportation of the blanks (10). The latter are deformed back into an essentially planar starting position upon leaving the rounding turret (18) and thereafter.

10 Claims, 5 Drawing Sheets

18
19
20
21
22
23
24
25
26
27
57
10
16
14
15
30
35

PROCESS FOR PRODUCING HINGE-LID BOXES

BACKGROUND OF THE INVENTION

The invention relates to a process for producing (cigarette) packs of the hinge-lid-box type with cross-sectionally round or beveled upright pack edges—round edges or oblique edges—non-folded, planar blanks being pre-shaped with the aid of rounding or beveling tools in the region of the round edges or oblique edges which are to be produced and then being processed in the usual manner for producing the hinge-lid box in a packaging machine. The invention also relates to an apparatus for carrying out the process.

Hinge-lid boxes for cigarettes configured as round-edged packs (U.S. Pat. No. 4,753,383) or octagonal packs (U.S. Pat. No. 4,753,384) are becoming increasingly common. In order to obtain precisely shaped round edges or oblique edges during the production of this type of pack, in particular of the round-edged pack, with the help of a conventional packaging machine for hinge-lid boxes, it is known for the non-folded blanks to be subjected to pre-shaping before being introduced into the packaging machine, in that the pack edges concerned are pre-shaped with the aid of rounding or beveling tools and the blank is then introduced into the packaging machine (U.S. Pat. No. 5,549,537).

In the case of this known arrangement, individual blanks are subjected to this preliminary processing, in the region of a pack path leading to the packaging machine, during a standstill phase. This adversely affects the output capacity of the packaging machine.

SUMMARY OF THE INVENTION

The object of the invention is to improve the output capacity of a packaging machine for producing hinge-lid boxes with round edges or oblique edges while, at the same time, increasing the quality of the pack edges formed.

In order to achieve this object, the process according to the invention is characterized in that the blanks are deformed to give round edges or oblique edges during continuous transportation, and are then shaped back essentially into the planar starting position.

In the case of the process according to the invention, the preliminary deformation of the pack edges thus takes place during transport of the blanks, i.e. during their conveying movement, the blank being shaped back into the (approximately) planar starting position following the preliminary shaping process, with the result that essentially planar blanks which are made of thin cardboard and have an altered structure in the region of the round edges are made available to the packaging machine.

The apparatus according to the invention is equipped with a preferably continuously circulating blank conveyor, in particular with a turret, which has a plurality of mounts or securing means for in each case one blank, each mount or each securing means being assigned tools or means which carry out the preliminary deformation of the blank, in particular a complete rounding process, during the conveying or rotary movement of the turret.

A further special feature of the invention is that, following completion of the preliminary shaping process, the blanks are transferred to a stacker in order to form a blank stack. This entire stack is subjected to deformation in the region of the pack edges, to be precise in particular to a reverse deformation counter to the preliminary shaping of the round edges or oblique edges, this resulting in the formation of blank stacks comprising pre-treated, planar blanks.

BRIEF DESCRIPTION OF THE DRAWINGS

Further special features of the process and of the apparatus are explained in more detail below with reference to the drawings which show.

DETAILED DESCRIPTION OF THE INVENTION

Figure 1:
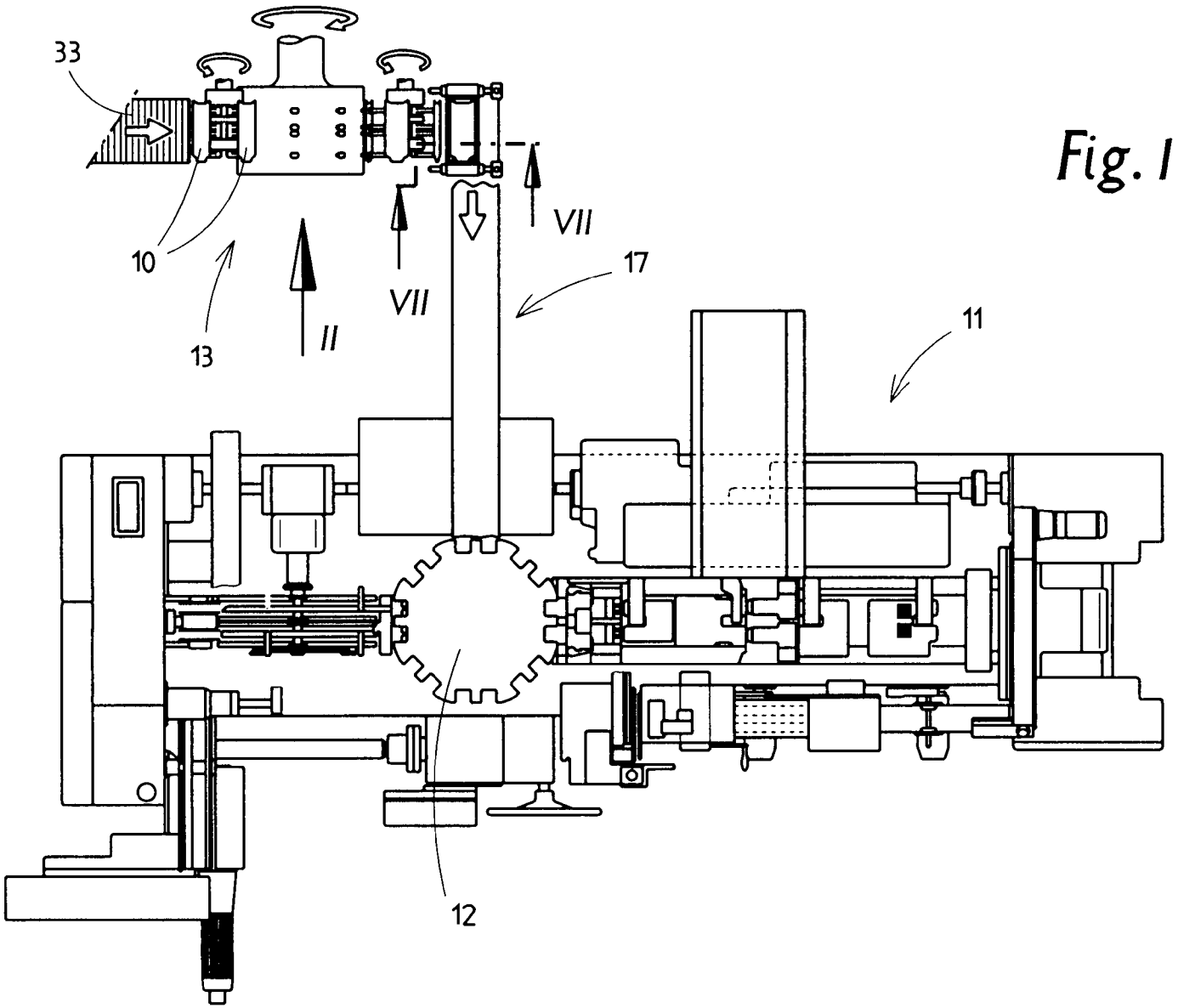
FIG. 1 a packaging machine in a schematic plan view.

The drawings relate to the processing of blanks 10 for producing round-edged packs (U.S. Pat. No. 4,753,383). FIG. 1 shows a plan view of a packaging machine 11 which serves for producing (cigarette) packs of the hinge-lid-box type. The packaging machine 11 has, as folding subassembly, a folding turret 12 which is designed in the form of a disc and can be rotated about an upright axis. The blanks 10 are to be fed to said folding turret in order for the hinge-lid boxes to be produced.

Figures 3, 4, 5, 6:
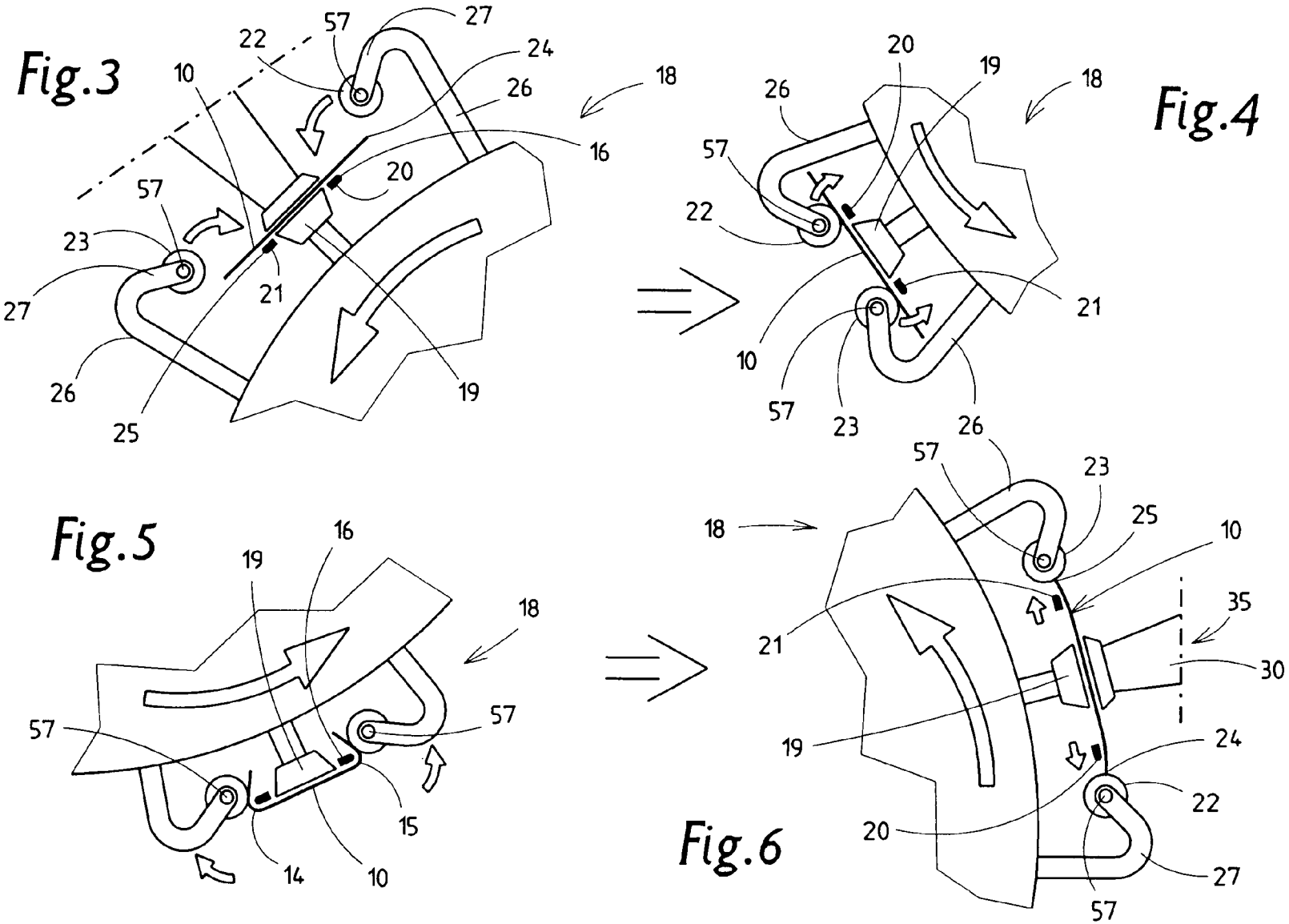
Figure 8:
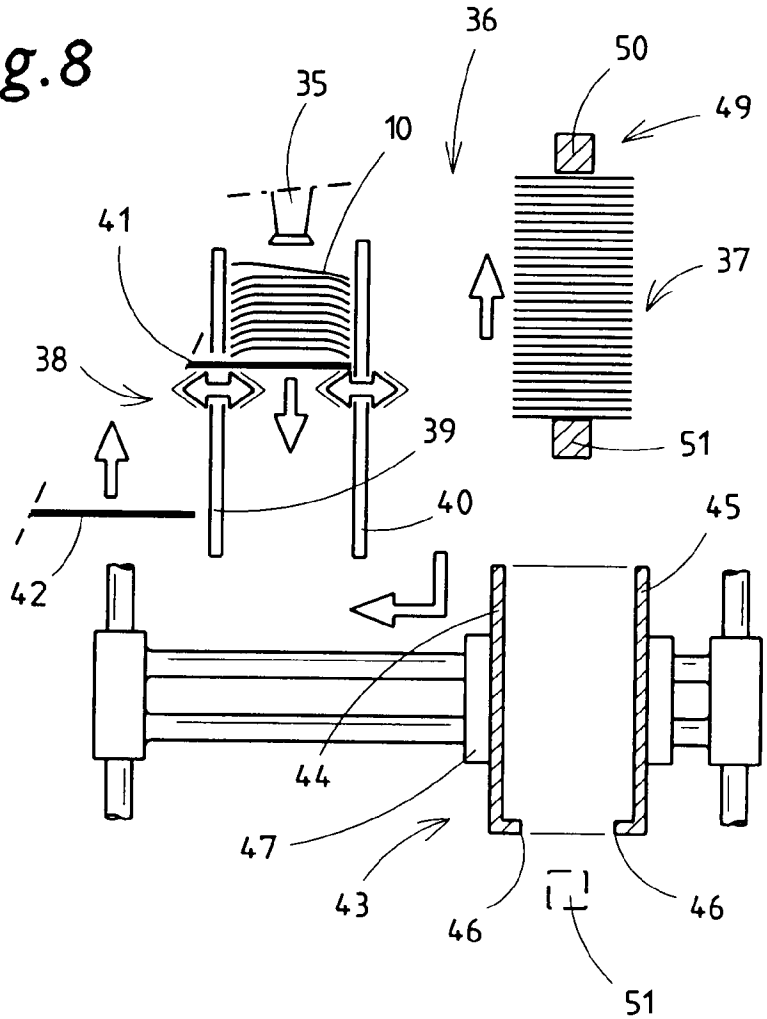

For producing hinge-lid boxes of the round-edged (or oblique-edged) type, the blanks 10 are pretreated in the region of a shaping subassembly 13. This involves round edges 14, 15 of the blanks 10 being pre-shaped by appropriate bending (FIG. 5). The shaping subassembly 13 is designed as an independent unit which is spaced apart from the packaging machine 11. The blank stacks or blanks 10 treated are transported by a blank conveyor, namely by a stack conveyor 17, from the shaping subassembly 13 to the packaging machine 11 and/or to the folding turret 12. Arranging the shaping subassembly 13 independently alternatively allows the packaging machine 11 to be operated for producing conventional hinge-lid boxes. In this case, the shaping subassembly 13 may be removed or possibly shifted.

The shaping subassembly 13 is designed in a particular manner. The most important detail is an endless conveyor, namely a rounding turret 18. The latter is preferably driven in a continuously rotating manner, to be precise about a horizontal axis. The blanks 10 are fed individually, one after the other, to the rounding turret 18 and conveyed along part of its circumference. Over this transporting section, the blanks 10 are processed, that is to say the round edges 14, 15 are formed. For this purpose, the rounding turret 18 is provided, along the circumference, with a plurality of equally spaced-apart securing means for one or more blanks 10. These securing means are radially directed suction holders 19 which grip the blank 10 in a central region and fix it by suction air. The suction holders 19 are designed such that lateral regions of the blank 10, in particular the region of the round edges 14, 15, are left free.

The securing means or each suction holder 19 has shaping means, namely shaping members 20, 21, which are positioned on both sides of the suction holder 19 and (temporarily) extend precisely in the region of the round edges 14, 15, to be precise in an axis-parallel direction in accordance with the orientation of the elongate blanks 10. Each shaping member 20, 21 is provided with a sideways directed rounding 16 around which a laterally projecting free border strip of the blank 10 is shaped, the round edge 14, 15 being formed in the process (FIG. 5). The free border strips of the blanks 10 here are deformed to the extent where they are directed at an acute angle to the plane of the blank 10.

In order to deform the blanks 10, shaping tools are fitted on the rounding turret 18, that is to say are assigned to each suction holder 19. These tools are in the form of rounding rollers 22, 23 on both sides of the suction holder 19 in each case. The rounding rollers 22, 23 are directed in an axis-parallel manner and can be moved in the radial direction in relation to the rounding turret 18, and transversely thereto. A starting position is shown in FIG. 3. The rounding rollers 22, 23 here are spaced apart from one another by a distance which is larger than the transverse dimension or width of the blank 10, with the result that the latter can be positioned on the suction holder 19 without being adversely affected by the rounding rollers 22, 23. The rounding rollers 22, 23 here are located in a position at a relatively large distance from the rounding turret 18 and/or on the radially outer side of the blank 10. The rounding rollers 22, 23 are then moved into a position at a smaller distance from one another, with abutment against the radially outer side of the blank 10 (FIG. 4). Thereafter, the rounding rollers 22, 23 are moved in order to deform a free border strip of the blank 10 around the shaping members 20, 21. During the rounding deformation of the blank 10, the rounding rollers 22, 23 thus execute essentially a radial movement from the outside inward, with the result that legs at the borders of the blank 10, produced on account of the round edges 14, 15 formed, are oriented radially inwards (FIG. 5). During this rounding operation, the rounding rollers execute a rotary movement, and thus roll on the outside of the blank 10. In the end position, the rounding rollers 22, 23 extend in a region between the shaping members 20, 21 and the rounding turret 18 (FIG. 5), with the distance between them once again being reduced, with the result that the free lateral strips of the blank 10 are "overbent".

The rounding rollers 22, 23 are then moved in the opposite direction, or at any rate at a greater distance apart from one another, such that lateral peripheral edges 24, 25 of the blank are supported on the circumference of the rounding rollers 22, 23 (FIG. 6). In this phase, during the reverse shaping of the blank 10, the shaping members 20, 21 move along into the (planar) starting position. This is because the shaping members 20, 21, for this purpose, can be moved apart from one another in opposite directions, as a result of which the blank 10 is moved into the straightened-out position. This reverse shaping movement of the shaping members 20, 21 is coordinated with the movement of the rounding rollers 22, 23. The pre-shaped blank 10 can then be removed from the rounding turret 18.

The rounding rollers 22, 23 are fitted on suitable holders which execute the movement sequences described above. In the exemplary embodiment shown, the rounding rollers 22, 23 are fitted on angled supporting arms 26, namely on a leg 27 of the supporting arm 26 which is directed towards the suction holder 19. During the rotation of the rounding turret 18, the supporting arms 26 can be moved, in the manner described, by suitable gear mechanisms within the rounding turret 18, via cams with the aid of cam rollers. The deformation of the blank 10 takes place in a region of rotation of the rounding turret 18 which corresponds approximately to three quarters of a revolution.

Figure 9:
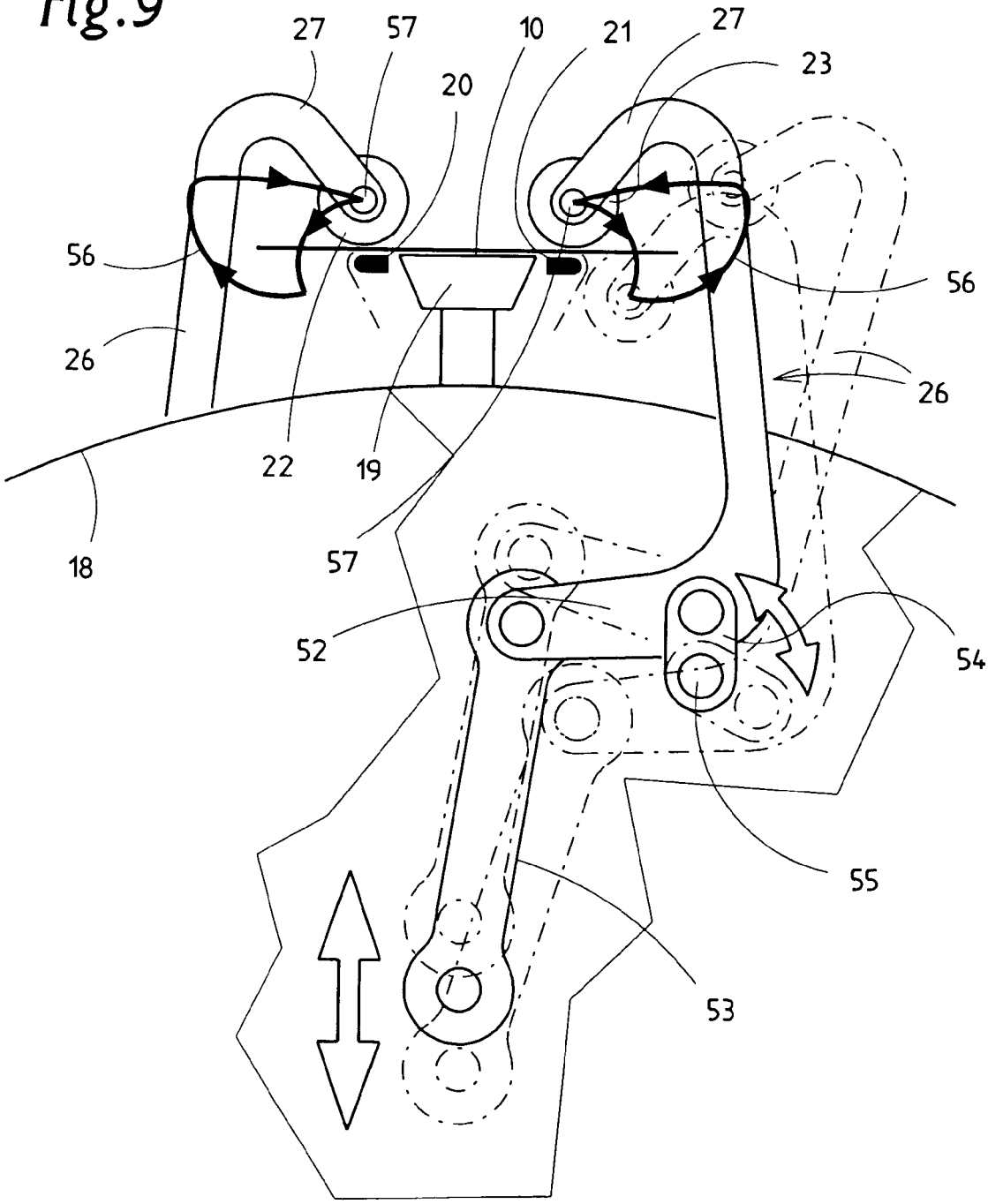
FIG. 9 the schematic representation of a detail of a (rounding) turret with packaging machine with gearing for the actuation of rounding elements, in side view.

FIG. 9 shows, as an exemplary embodiment, a gear mechanism arranged essentially within the rounding turret 18 for actuating the rounding rollers 22, 23. The supporting arm is bent (within the rounding turret 18) to form a leg 52 pointing in the direction of movement. It free end is connected by means of a joint to a drive lever 53. The latter can be moved back and forth essentially in the radial direction of the rounding turret 18 for the purpose of actuating the supporting arm 26 (in the positions shown by the dash-dotted lines). The drive lever 53 can move via a guide roller (not shown), which travels in a groove of the rounding turret 18. The leg 52 of the supporting arm 26 is connected to an articular lever 54 which has a stationary pivot bearing. FIG. 9 also shows the motional curve 56 of the rounding element during deformation of the blank 10, specifically about a rotational axis 57 of the rounding rollers 22, 23 at the supporting arm 26.

Figure 2:
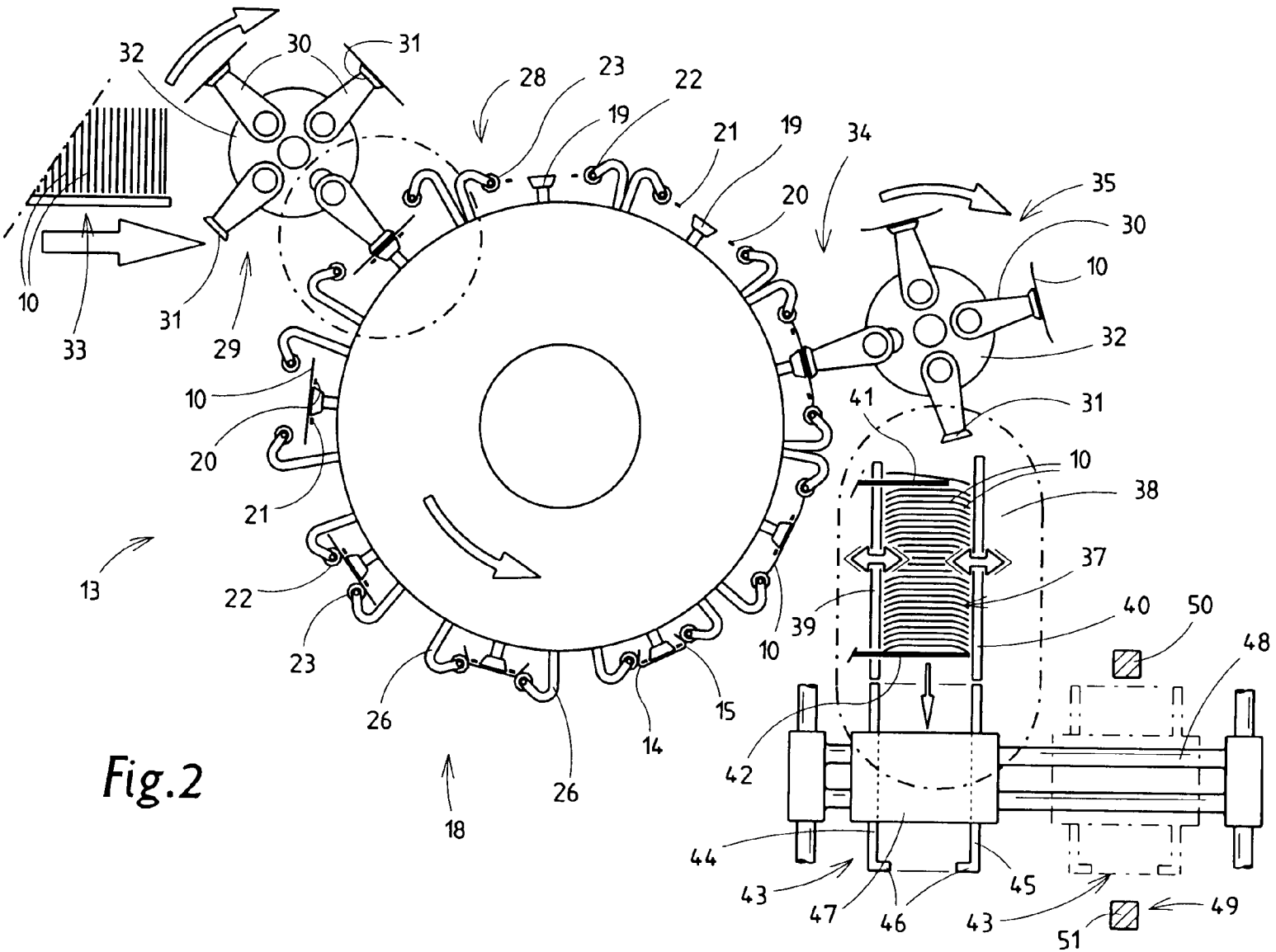
FIG. 2 on an enlarged scale, a detail of the packaging machine according to FIG. 1 in a side view according to arrow 11 in FIG. 1, FIGS. 3 to 6 on a further-enlarged scale, parts of the rounding turret with rounding tools in different phases of processing a blank, FIG. 7 on an enlarged scale, a stacking station for blanks in a side view and in a vertical section along section plane VII—VII from FIG. 1, and FIG. 8 the stacking station according to FIG. 7 with components in different positions.

In the region of a charging station 28, individual blanks 10 are transferred by a transfer conveyor 29 to the rounding turret 18 and/or to in each case one suction holder 19. The transfer conveyor 29 comprises (continuously) circulating retaining arms 30 for in each case one blank. In each case one suction means 31 is fitted at the radially outer end of the retaining arm 30 in order to retain the blank 10 on a (printed) outer side of the same. The retaining arms 30 are fitted on a circulating retaining disc 32 such that the retaining arms 30, when receiving a blank 10 and during transfer to the rounding turret 18, execute a compensatory pivoting movement (and a radial movement). The transfer conveyor 29 in this example is provided with four retaining arms 30, of which in each case one retaining arm 30 is free following transfer of a blank 10 to the rounding turret 18 (FIG. 2).

The blanks 10 are removed from a feed conveyor 33 one after the other by the transfer conveyor 29. The blanks 10 are positioned close together on this feed conveyor, to be precise in an upright plane with the longitudinal extent transverse to the movement direction. The blanks 10 are arranged such that in each case the printed outer sides are gripped by the transfer conveyor 29 and/or the suction means 31. The blanks 10 are transported along three quarters of a circle and transferred to the rounding turret 18.

In the region of a removal station 34, the pre-shaped blanks 10 are removed from the rounding turret 18 by a removal conveyor 35 and fed to a stacking subassembly 36. The removal conveyor 35 is designed in an analogous manner to the transfer conveyor 29, that is to say with retaining arms 30 and suction means 31. At the moment a blank is received, it is positioned by the suction holders 19 of the rounding turret 18, the shaping members 20, 21 and the rounding rollers 20, 23 such that a movement counter to the rounding operation takes place, with the result that the blanks 10 are shaped back more or less into the original straightened-out position (FIG. 6).

Figure 7:
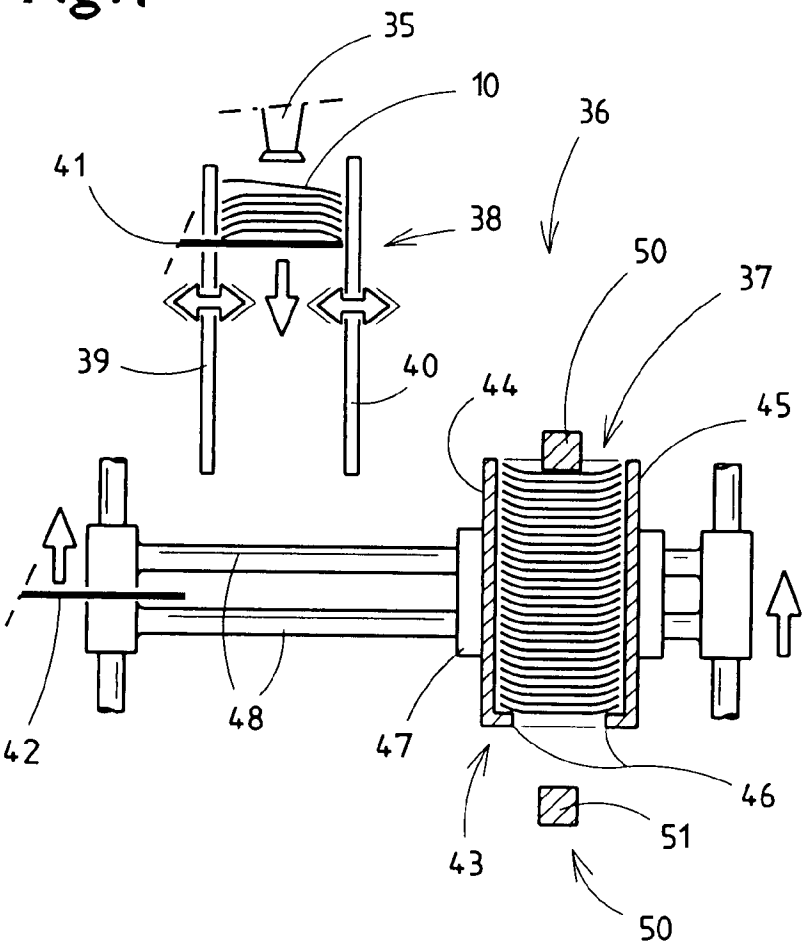

In respect of construction and operation, the stacking subassembly 36 constitutes a special feature. On the one hand, it serves for producing blank stacks 37, in the form of a unit, for the further processing of the blanks 10. On the other hand, the stacking subassembly 36 serves for (additionally) deforming the blanks 10, to be precise by deforming an entire blank stack 37 (FIG. 7). In the present exemplary embodiment, the blank stack 37 is subjected to deformation which counteracts the preliminary deformation of the individual blanks 10 in the region of the rounding turret 18, that is to say makes an additional contribution to deforming the blanks 10 back into an essentially planar starting position.

The stacking subassembly 36 comprises an upright stacking tower 38 with upright guide walls 39, 40 which butt against the peripheral edges 24, 25 of the blanks 10, said edges running in the longitudinal direction of the blanks. The blank stack 37 is constructed between the guide walls 39, 40, to be precise by individual blanks 10 being fed at the top side. The bottom boundary of the stacking tower 38 is formed by a supporting tongue or supporting wall 41. This can be moved transversely to the stacking tower 38; by transverse displacement, it can be drawn out of the region of the stacking tower 38 or of the supporting position between the guide walls 39, 40 such that the blank stack 37 formed above the supporting wall 41 can be conveyed away in the downward direction. A special feature consists in the fact that blank stacks 37 are formed one after the other in the stacking tower 38. As soon as a filling level corresponding to a blank stack 37 has been reached in the stacking tower 38, a second supporting wall 42 is displaced transversely into the stacking tower 38 above the blank stack 37, with the result that subsequently fed blanks 10 serve for forming a subsequent blank stack 37 on the second supporting wall 42.

The finished blank stack 37 is transferred, by downward movement, to a conveyor, namely to a conveying shaft 43. This comprises upright shaft walls 44, 45 which, in a receiving position, adjoin the guide walls 39, 40 of the stacking tower 38. At the bottom, the blanks 10 or the blank stack 37 rest/rests on supporting means, namely on supporting legs 46 of the shaft walls 44, 45.

The transfer of the blank stack 37 from the stacking tower 38 to the conveying shaft 43 is brought about by the respectively bottom supporting wall 41, 42 being moved downwards. The supporting walls 41, 42 and the guide walls 39, 40 are coordinated with one another in respect of configuration, for example by way of a comb-like design, such that the supporting walls 41, 42, moved downwards within the stacking tower 38, can be drawn laterally out of the stacking tower 38 or of the conveying shaft 43 in a bottom end position (FIG. 7) and, outside said tower or shaft, can be moved back into a top starting position (FIG. 2). The guide walls 39, 40 of the stacking tower 38 can be moved transversely in an oscillatory manner in order to facilitate the stack formation and the downward movement of the blank stack 37 for transfer to the conveying shaft 43.

The conveying shaft 43 is part of a stack conveyor. In the exemplary embodiment shown, the conveying shaft 43 can be moved transversely and, for this purpose, is fitted on a carriage 47. The latter can be moved back and forth in the horizontal direction on a guide with guide rods 48, namely from a starting position of the conveying shaft 43 beneath the stacking tower 38 into an offset position (FIG. 7). From here, the blank stack 37 is transported further and, for this purpose, lifted out of the conveying shaft 43 by a lifting means 49. This is equipped with supporting components 50, 51 on the top side and underside of the blank stack 37. The supporting components can be moved relative to one another and relative to the conveying shaft 43. For the purpose of gripping a blank stack 37 in the conveying shaft 43, the supporting components 50, 51 are moved towards the blank stack 37 from the top and bottom.

A special feature consists in that the supporting components 50, 51 perform a double function, that is to say they also serve as tools for shaping the blanks 10 and the blank stack 37 as a whole. As can be seen from FIG. 7, in the first instance only the top supporting component 50 is lowered onto the blank stack 37. Since the latter is only supported around the borders on the opposite, bottom side, namely by the supporting legs 46, the action of the supporting component 50 transmitting pressure in the central region of the blank 10 results in downwardly directed deformation of the entire blank stack 37 and thus in reverse deformation of the blanks 10 into the planar starting form.

Once processing has been completed, the blank stack 37 is then fed to the packaging machine 11 and/or the folding turret 12, to be precise in particular via the stack conveyor 17.

What is claimed is:

1. Apparatus for producing packs, of the hinge-lid box type with cross-sectionally round upright pack edges (14, 15), in a packaging machine (11) having folding means, wherein planar elonaged blanks (10) for the hinge-lid boxes are to be pre-shaped with the aid of rounding rollers (22), and then are to be fed to the packaging machine (11) for producing the hinge-lid boxes, comprising:

a) a continually rotating rounding turret, b) means for feeding the blanks (10) in succession to the continually rotating rounding turret (18) which has plural securing means (19) for securing one blank (10) each, c) a transfer conveyor (29) which feeds the blanks (10) to a charging station (28) located adjacent to the rounding turret (18), and a feed conveyor (33) which removes individual blanks (10) from the transfer conveyor (29) and conveys them to respective ones of said securing means (19) of the rotating rounding turret (18), d) means for arranging the blanks (10), on the securing means (19), with a longitudinal extension thereof aligned in an axis-parallel direction transverse to the rotation path of the rounding turret (18), e) arranged as shaping tools on both sides of each securing means (19), rounding rollers (22, 23) that are movable relative to the securing means (19), f) each securing means (19) also comprising on either side thereof shaping members (20, 21) having lateral roundings (16) in a region of the round pack edges (14, 15) to be formed, g) border areas of each blank (10) being shaped around the shaping members (20, 21) by the rounding rollers (22, 23), with the round edges (14, 15) abutting the lateral roundings (16) of the shaping members (20, 21) in the region of the round edges (14, 15), and h) in a region of a removal station, a removal conveyor (35) which removes the blanks (10), preformed with respect to the pack edges, from their respective securing means (19).

2. Apparatus according to claim 1, comprising means for shaping the blanks (10), preformed with respect to the round edges (14, 15), back into their essentially planar starting form by corresponding relative positioning of the rounding rollers (22, 23) and/or of the shaping members (20, 21).

3. Apparatus according to claim 2, comprising means for moving the shaping members (20, 21) transversely in a plane parallel to the blank (10) and/or more or less tangentially to the rounding turret (18), so that the shaping members are moved apart from one another in order to deform the blank (10) back into an essentially planar starting position.

4. Apparatus according to claim 1, wherein the rounding rollers (22, 23) are mounted on supporting arms (26) which are connected to the rounding turret (18), and are movable in a radial direction, and transversely thereto, in order to execute rounding movements.

5. Apparatus according to claim 1, comprising: a stacking subassembly (36); and means for feeding the blanks (10), after being taken from the rounding turret (18) in the region of the removal station (34), to the stacking subassembly (36) in order to form blank stacks (37), the stacking subassembly (36) having an upright stacking tower (38) to which blanks are fed via an open, top side of the stacking tower.

6. Apparatus according to claim 5, wherein the stacking tower (38) comprises lateral, upright guide walls (39, 40) and at least one supporting wall (41, 42) as a rest for each blank stack (37) formed, said apparatus comprising means for drawing the supporting wall (41, 42) laterally out of the stacking tower (38) in order for the blank stack (37) to be conveyed away.

7. Apparatus according to claim 5, comprising a conveying shaft (43), wherein the stacking tower (38) has at least two bottom supporting walls (41, 42) which serve alternately as a bottom boundary or as a rest for a blank stack (37), said apparatus further comprising means for moving a respective bottom supporting wall (41, 42) downwards with the blank stack (37) in order for the blank stack (37) to be transferred to the conveying staff (43).

8. Apparatus according to claim 7, comprising means for displacing the conveying shaft (43) in order for the blank stack (37) to be transported away in the transverse direction while carrying along the blank stack (37) in the process, the conveying shaft (43) comprising lateral shaft walls (44, 45) with bottom supporting legs (46) for the blank stack.

9. Apparatus according to claim 7, comprising at least one pressure-exerting supporting component (50), wherein the blank stack (37) can be deformed as a whole, in particular with the effect of reverse deformation of the blanks (10), said at least one pressure-exerting supporting component (50) acting approximately centrally on a free top side of the blank stack, in a region of the conveying shaft (43) in order to transmit pressure to the blank stack (37), the latter being supported around a border thereof on an underside thereof.

10. Apparatus according to claim 7, comprising lifting means for transporting the blank stack (37) out of the conveying shaft (43), said lifting means (49) having supporting components (50, 51) which grip the blank stack (37) a the top and a bottom thereof.

* * * * *